US011692786B2

(12) United States Patent
Hoodecheck et al.

(10) Patent No.: US 11,692,786 B2
(45) Date of Patent: Jul. 4, 2023

(54) FIREARM CLEANING DEVICE

(71) Applicant: FULLBLAST ENTERPRISES, LLC, Lone Tree, CO (US)

(72) Inventors: Stephen C. Hoodecheck, Lone Tree, CO (US); Adam Joseph Zimmer, Denver, CO (US)

(73) Assignee: FULL BLAST ENTERPRISES, LLC, Lone Tree, CO (US)

( * ) Notice: Subject to any disclaimer, the term of this patent is extended or adjusted under 35 U.S.C. 154(b) by 0 days.

(21) Appl. No.: 17/581,317

(22) Filed: Jan. 21, 2022

(65) Prior Publication Data

US 2022/0146228 A1 May 12, 2022

Related U.S. Application Data

(63) Continuation-in-part of application No. 17/130,854, filed on Dec. 22, 2020, now Pat. No. 11,473,868.

(60) Provisional application No. 62/970,678, filed on Feb. 5, 2020, provisional application No. 62/953,113, filed on Dec. 23, 2019.

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 35/00; F41A 29/00; B08B 9/00; B08B 2209/04; B08B 9/0436; B25H 3/021; B65D 50/04; F41C 27/00; F41C 33/00
USPC ..... 42/95; 102/442
See application file for complete search history.

(56) References Cited

U.S. PATENT DOCUMENTS

| | | | |
|---|---|---|---|
| 1,195,308 | A | 8/1916 | Whidden |
| 1,415,950 | A | 5/1922 | Poole |
| 1,863,950 | A | 6/1932 | Stubbs |
| 1,882,576 | A | 10/1932 | Alfred |
| 1,920,283 | A | 8/1933 | Vroom |
| 1,996,544 | A | 4/1935 | Justice |
| 2,642,602 | A | 6/1953 | Kelly |
| 2,728,929 | A | 1/1956 | Leslie |
| 2,755,496 | A | 7/1956 | Benyak |
| 2,805,434 | A | 9/1957 | Hopkins |
| 3,205,518 | A | 9/1965 | Romaine |
| 3,466,691 | A | 9/1969 | Wessel |
| 4,144,609 | A | 3/1979 | Dubs |
| 4,310,942 | A | 1/1982 | Krape |
| 4,503,578 | A | 3/1985 | McIntyre |
| 4,546,519 | A | 10/1985 | Pembroke |
| 4,547,924 | A | 10/1985 | Brygider |
| 4,674,218 | A | 6/1987 | Bottomley |
| 5,204,483 | A | 4/1993 | Tellechea |
| 5,588,242 | A | 12/1996 | Hughes |

(Continued)

FOREIGN PATENT DOCUMENTS

| | | | |
|---|---|---|---|
| DE | 3714030 | A1 | 12/1988 |
| WO | 2019074818 | A1 | 4/2019 |

*Primary Examiner* — Michael D David
(74) *Attorney, Agent, or Firm* — Voz Patents, LLC

(57) ABSTRACT

Embodiments of the invention discussed herein surround cleaning of firearms which are configured to pass through internal aspects—such as through a barrel and/or breach of a firearm. Embodiments include the use of various cleaning elements combinable with each other to provide a faster and more efficient cleaning of internal aspects of a firearm.

15 Claims, 12 Drawing Sheets

(56) References Cited

U.S. PATENT DOCUMENTS

| | | | | |
|---|---|---|---|---|
| 5,871,589 | A | 2/1999 | Hedge | |
| 5,972,125 | A | 10/1999 | Hedge | |
| 6,269,577 | B1 * | 8/2001 | Hardy | F41C 27/00 42/72 |
| RE38,247 | E | 9/2003 | Wickser, Jr. | |
| 8,371,441 | B2 | 2/2013 | Williams | |
| 8,448,370 | B2 | 5/2013 | Williams | |
| 9,134,087 | B2 | 9/2015 | Canham | |
| 10,012,466 | B2 | 7/2018 | Whitworth | |
| 10,605,564 | B2 | 3/2020 | Kokoruda et al. | |
| 10,948,256 | B2 | 3/2021 | McDonald et al. | |
| 2002/0129725 | A1 | 9/2002 | Bice et al. | |
| 2006/0260079 | A1 | 11/2006 | Horton | |
| 2006/0277811 | A1 | 12/2006 | Peterson | |
| 2007/0051027 | A1 | 3/2007 | Stordal | |
| 2007/0151055 | A1 | 7/2007 | Chee et al. | |
| 2007/0261288 | A1 | 11/2007 | Perry et al. | |
| 2009/0065028 | A1 | 3/2009 | Pulliainen | |
| 2011/0083354 | A1 | 4/2011 | Krieger | |
| 2011/0107646 | A1 | 5/2011 | Anderson | |
| 2011/0119845 | A1 | 5/2011 | Kim | |
| 2011/0209379 | A1 | 9/2011 | Williams | |
| 2017/0336166 | A1 | 11/2017 | Rohlin et al. | |
| 2019/0107357 | A1 | 4/2019 | McDonald et al. | |
| 2021/0190454 | A1 * | 6/2021 | Hoodecheck | F41A 29/02 |
| 2022/0146228 | A1 | 5/2022 | Hoodecheck et al. | |

* cited by examiner

SECTION B-B

DETAIL C

SECTION E-E

DETAIL D

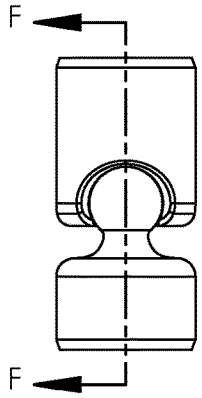
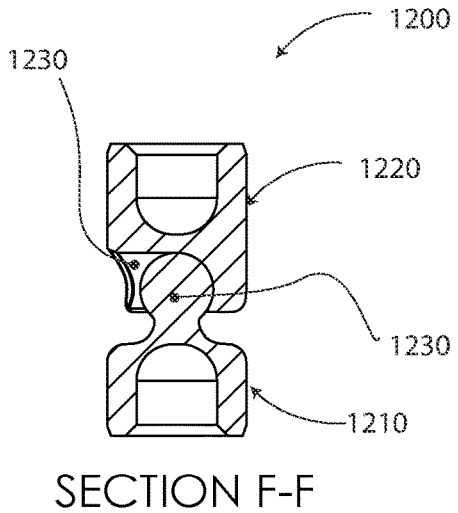
FIG. 2A FIG. 2B
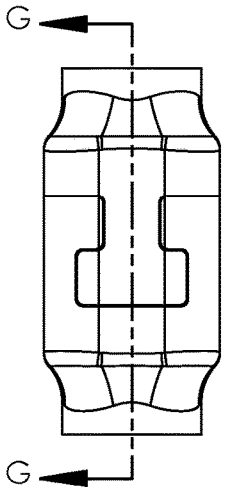
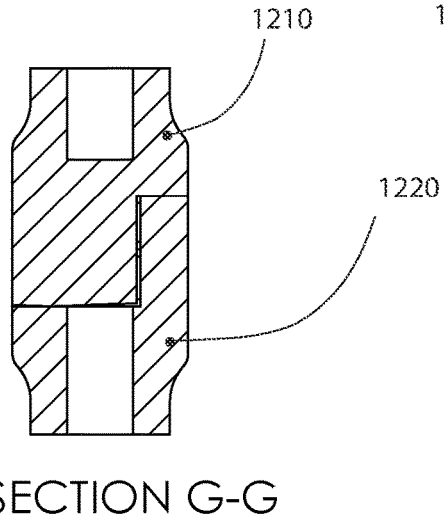
FIG. 3A FIG. 3B
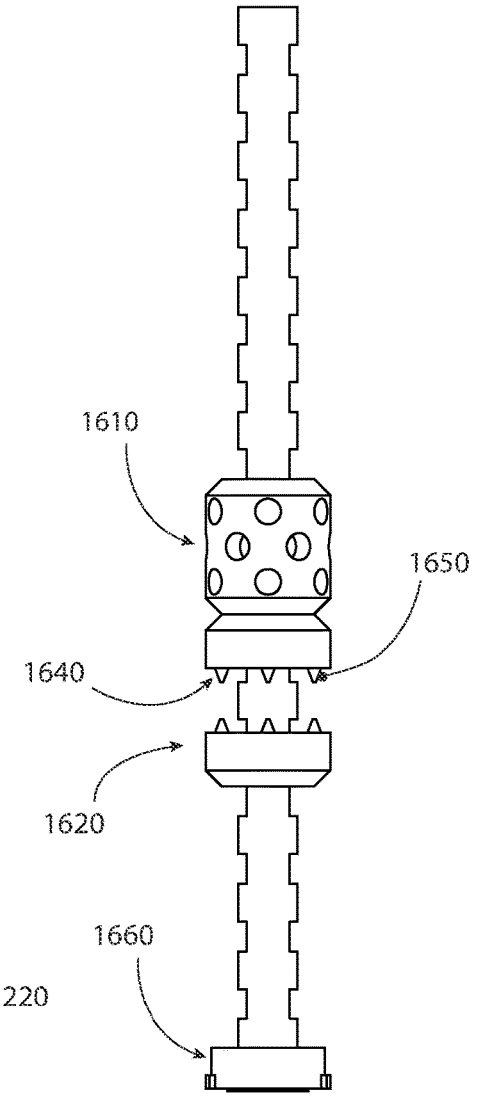
FIG. 4

FIREARM CLEANING DEVICE

CROSS REFERENCE TO RELATED APPLICATIONS

This application is a Continuation in Part of U.S. patent application Ser. No. 17/130,854 entitled "Firearm Cleaning Device" filed on Dec. 22, 2020; which claims the benefit of U.S. Provisional Patent Application 62/953,113 entitled "Profile Cleaner" filed on Dec. 23, 2019; and U.S. Patent Application No. 62/970,678 entitled "Profile Cleaner" filed on Feb. 5, 2020, the entire contents of which are incorporated herein by reference in their entirety for all purposes.

FIELD OF THE INVENTION

The present invention is directed to a firearm cleaning device and system configured to clean the internal profile of a firearm. Certain embodiments of the present invention are modular and reconfigurable, allowing user to remove different types of contaminants, or to apply surface coatings, in one pass. Certain embodiments of the invention disclosed herein allows the use of multiple cleaning segments, allowing for more effective and efficient volume cleaning when the firearm cleaning device is pushed and/or pulled through the volume of the firearm.

BACKGROUND OF THE INVENTION

The use of firearms involves the rapid combustion of black powder or similar accelerants to propel a projectile down the barrel of the firearm. The combustion of these accelerants results in the deposition of post-combustion residues, or fouling, on the interior and exterior aspects of the firearm. In some cases, fouling includes metal particulate from the projectile or the barrel. These residues and fouling if left unaddressed, can not only negatively affect the performance of the firearm over time, resulting in unreliable and unpredictable performance. Such unreliable and unpredictable performance of a firearm can manifest as safety related issues such as hang-fires, misfires, failure to eject scenarios, and jamming. Such incidents can be range from frustrating to dangerous depending on the situation and the type of malfunction.

In particular, the cleaning of a barrel is often the most cumbersome as the internal bore of the barrel requires cleaning and application of an anti-corrosion agent for storage purposes. Furthermore, any existing buildup of residues must be able to remove the residue, without abrading or damaging the precision or surface quality of the internal surface of the bore as doing so would result in degrading the performance of the barrel.

The present invention aims to provide a cleaning device allowing a user to easily and efficiently clean a firearm, thereby increasing the reliability of the firearm, and mitigating any potential degradation of reliability or performance of the firearm.

SUMMARY OF THE INVENTION

The present invention surrounds a modular cleaning device for the purposes of cleaning a firearm, such as after use.

Certain firearm cleaning tools, as shown in U.S. Pat. No. 5,871,589 to Hedge ("Hedge"), provides a metallic brush enclosed within a tubular sheath of woven fabric such that the bristles of the brush extend through the wall of the fabric.

This allows the sheath to be pulled through a barrel to allow the brush to scour the internal surface of the bore, while a bulge in the tubular sheath created by a foam insert therein cleans the debris away from the surface after scouring. Such technologies do not permit a user to modify the firearm cleaner in a manner to be used in multiple firearms, and thus requires a user to have a specific cleaning tool for each particular firearm bore or type. Furthermore, cleaning tools such as disclosed by Hedge only allow for the pulling of the cleaning tool through the bore, and do not permit a user to push the cleaning tool through the bore of the firearm.

It is an aspect of certain embodiments of the present invention to allow a user to reconfigure a firearm cleaning device based on the bore, caliber, gauge, and type of the firearm as desired. It is a further aspect of certain embodiments of the present invention to permit a user to alternatingly push or pull a firearm cleaning device through the bore of a firearm.

It is an aspect of certain embodiments of the present invention to allow a user to modularly reconfigure a firearm cleaning device through the use of interconnectable segments wherein each segment has a first end and a second end, and the first end of each segment comprises a first coupler which is interconnectable to a second coupler of a second segment. Such interconnectable segments include, but are not limited to: brushes, cleaning elements, rigid shafts, semi-rigid shafts, deformable cleaning member, bore cleaning element, mops, and other segments known to those skilled in the art configured to scour, wipe, or otherwise clean the internal bore of a firearm barrel.

While cleaning tools which permit either the pushing or pulling of a firearm cleaning device through the bore of the firearm exist, cleaning tools allowing both the pushing and pulling of through the bore of a firearm such as those disclosed by:

U.S. Pat. No. 4,547,924 to Brygider ("Brygider");
U.S. Pat. No. 4,674,218 to Bottomley ("Bottomley");
U.S. Pat. No. 5,204,483 to Tellechea ("Tellechea");
U.S. Patent Publication No. 2007/0051027 to Stordal ("Stordal");
U.S. Patent Publication No. 2007/0261288 to Perry et al. ("Perry"); and
U.S. Reissued Patent No. RE38,247 to Wickser (Wickser"), the contents of which are incorporated by reference all purposes—such cleaning tools are limited to a rigid rod which must be advanced through the barrel from the muzzle-end rather than through the breach-end of the barrel. It will be appreciated by those skilled in the art that forcing objects, such as cleaning elements, in a direction opposite the direction of travel of a firearm can result in the premature degradation of performance due to wear upon the rifling of the barrel.

It is an aspect of the present invention to allow the advancing of a cleaning device through the breach-end of the barrel with a semi-rigid shaft which allows a user to initially introduce the cleaning device through the breach, into the breach-end of the barrel, and push the cleaning device toward the muzzle-end, permitting the user to pull the cleaning device out through the muzzle-end of the barrel, thus pushing the residue and fouling byproducts out of the muzzle end of the barrel. The semi-rigid properties allow both the flexibility of the shaft as well as the anti-kinking properties for when the semi-rigid shaft is pushed through the internal aspects of a firearm. The ability to push and pull embodiments of the present invention further permits cleaning activities such as scrubbing a particular area of a firearm's internal aspects by alternately pushing and pulling the device in a back-and-forth motion.

It is a further aspect of the present invention to provide a system wherein the first element comprises a scouring element, and the second element comprises a wiping element wherein the wiping element conforms to the internal profile of the barrel.

Some existing technologies, such as disclosed by U.S. Pat. No. 8,448,370 to Williams ("Williams")—herein incorporated by reference in its entirety for all purposes—include a patch receiving slot for the insertion of a patch of cloth. Use of patches of cloth are commonplace in the cleaning of firearms, but the patch cleaning slot of existing technologies allows only for a single cloth patch to be inserted therethrough. The patch of cloth inserted through the patch cleaning slot is forced through the bore of the barrel—pushed or pulled wherein the patch of cloth cleans only a first radial portion and a second radial portion of the 360-degrees internal circumference of the barrel wherein the first and second radial portions are 180-degrees opposed to each other. Resultantly, a user must repeatedly force a cloth patch through the barrel multiple times order to ensure thorough cleaning of the barrel.

It is an aspect of certain embodiments of the present invention to provide a bore cleaning element comprising a first aperture and a second aperture configured to receive a cloth patch, wherein the apertures are angularly offset by 90-degrees. By placing a first cloth patch through the first aperture, and a second cloth patch through the second aperture prior to forcing the cleaning element though the bore of the barrel, a user is able to thoroughly clean and oil the entirety of the internal surface of the bore of the barrel in a single pass. The first cloth patch cleans a first radial portion and second radial portion of the bore wherein the first and second radial portions are 180-degrees opposed. The second cloth patch simultaneously cleans a third radial portion and a fourth radial portion of the internal circumference of the bore wherein the third and fourth radial portions are 180-degrees opposed to each other, and 90-degrees opposed to the first and second radial portions. Furthermore, the first and second radial portions overlap with the third and fourth radial portions, thereby ensuring thorough cleaning of the bore of the barrel in a single pass. It will be appreciated that although embodiments shown comprise two apertures, embodiments comprising more than two apertures are in keeping with the spirit and scope of the present invention.

The cloth patch slot of existing technologies, such as disclosed in Williams are configured as an eyelet wherein the cloth patch must be threaded through the slot similarly to how a string is threaded through the eye of a needle. Cloth patches commonly used in the cleaning firearms are square shaped. Thereby, a user must thread a corner of the cloth patch axially through the slot prior to pulling it midway through the slot prior to forcing it through the bore of a barrel. This process is cumbersome and is increasingly difficult for those with limited manual dexterity, such as those with arthritis.

It is an aspect of the present invention to provide a solution wherein a user is able to place a cloth patch into an aperture from a lateral aspect. In certain embodiments, the aperture of the cleaning element comprises a lateral opening, thereby resulting in a hook-form and the cloth patch slot of a bore cleaning element comprises a hook-form. In certain embodiments the lateral opening is configured to result in an upper hook-form and a lower hook-form wherein a cloth path or other cleaning element disposed within the aperture is captive within the aperture regardless if the cleaning element is pulled or pushed through the firearm.

In certain embodiments of the present invention, a cleaning element comprises a flexible outer sleeve with a deformable element therein. The outer sleeve of certain embodiments comprises a textile sleeve configured to clean the internal aspects of a firearm. The textile sleeve is configured for cleaning, absorbing, and applying cleaning solutions and oils. The deformable element comprises an oblong shape and is able to conform to the internal aspects of the firearm as the cleaning element is forced through the internal aspects of the firearm.

Certain embodiments of the present invention comprise a hand-grip configured to provide a user increased ability to push or pull a longitudinal element through the barrel or other aspect of a firearm. A user can use the hand-grip with longitudinal elements such as a semi-rigid shaft, rigid elements, or flexible elements. The hand-grip is configured to receive the longitudinal element from a lateral aspect of the hand-grip allowing a user to use the hand-grip as desired without being limited to inserting a longitudinal element axially therethrough, thereby allowing a user to easily use the hand-grip to engage a longitudinal element without limit as to the size of elements interconnected to the ends of the longitudinal element. The hand-grip comprises an elastomeric composition such that the hand-grip is pliable and elastically deformable. Embodiments wherein the hand-grip comprises a silicone, rubber, or other elastomeric materials are within the spirit and scope of the present invention.

In certain embodiments, the hand-grip comprises protuberances configured to interface with longitudinal elements inserted within the hand-grip, wherein the protuberances are configured to deform and grip the longitudinal element inserted therein thereby increasing grip upon the longitudinal element even with wet or otherwise slippery surfaces.

When pushing a longitudinal element through the firearm, a user's hand may slip resulting in the user's hand impacting the firearm. Impacting the firearm with one's hand can be painful and can result in bruising or other injury. It is an aspect of certain embodiments to protect a user's hand from accidental contact with the firearm when pushing a longitudinal aspect through a firearm for cleaning. In certain embodiments the hand-grip comprises a hand-guard at a first end of the hand-grip wherein the hand-guard is configured to protect a user's hand from impacting the firearm when pushing a longitudinal element through the firearm.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
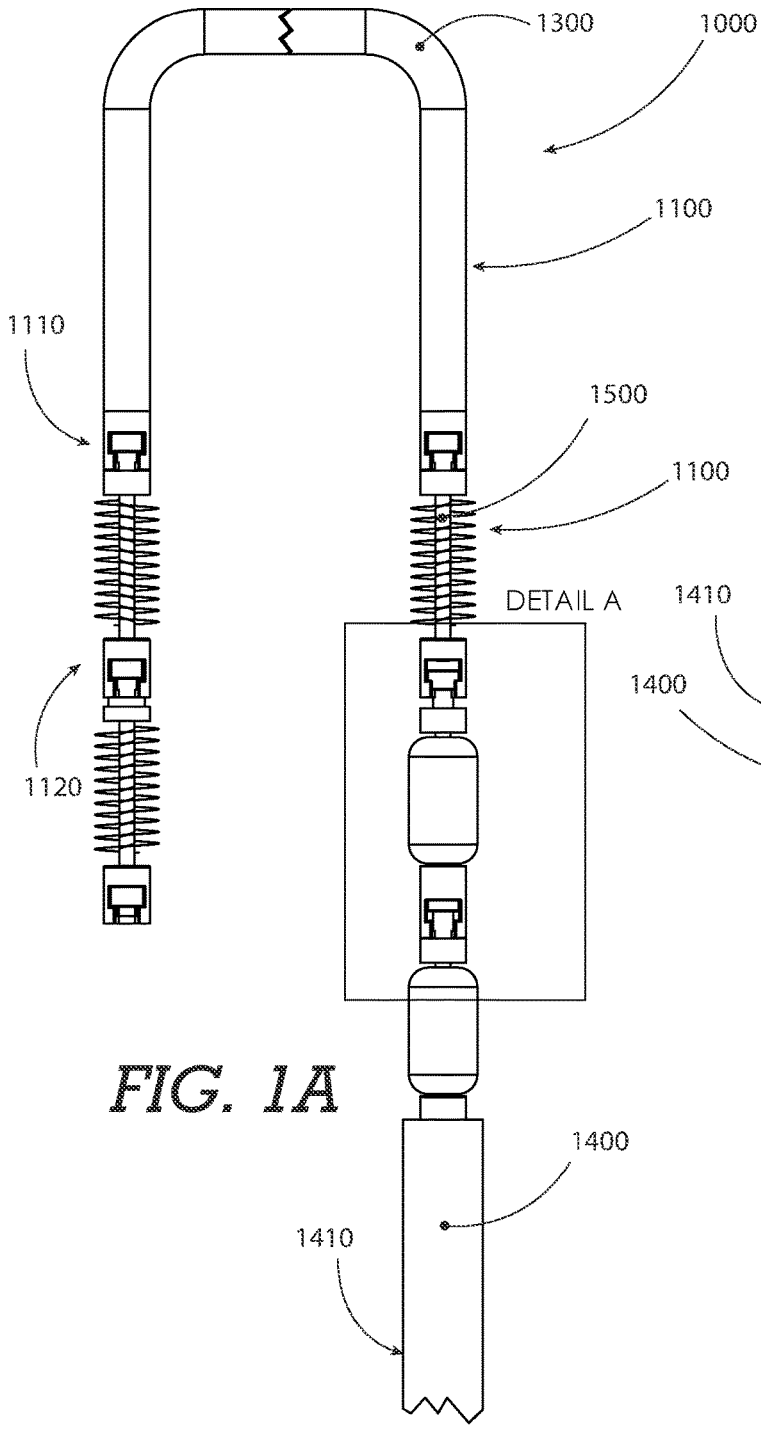
FIG. 1A—A system view of certain embodiments comprising a plurality of cleaning elements of various types FIG. 1B—A detail view of FIG. 1A FIG. 1C—A side view of the system view shown in FIG. 1A FIG. 1D—A section view of the system view shown in FIG. 1C FIG. 1E—A detail view of the system view shown in FIG. 1D FIG. 1F—A section view of the system view shown in FIG. 1E FIG. 1G—A detail view of the system view shown in FIG. 1D FIG. 2A—A side view of certain embodiments comprising a fastening feature FIG. 2B—A section view of certain embodiments shown in FIG. 2A FIG. 3A—A side view of certain embodiments comprising a fastening feature FIG. 3B—A section view of certain embodiments shown in FIG. 3A FIG. 4—A side view of certain embodiments comprising a cleaning element comprising clamping elements FIG. 5A—An overhead view of certain embodiments comprising a first fastening feature fully engaged with a second fastening feature FIG. 5B—An overhead view of certain embodiments comprising a first fastening feature partially engaged with a second fastening feature FIG. 5C—An overhead view of certain embodiments comprising a first fastening feature disengaged from a second fastening feature FIG. 5D—An overhead view of certain embodiments comprising a first fastening feature removed from a second fastening feature FIG. 6A—A side view of certain embodiments comprising a first fastening feature fully engaged with a second fastening feature FIG. 6B—A side view of certain embodiments comprising a first fastening feature partially engaged with a second fastening feature FIG. 6C—A side view of certain embodiments comprising a first fastening feature disengaged from a second fastening feature FIG. 6D—A side view of certain embodiments comprising a first fastening feature removed from a second fastening feature FIG. 7A—A section view of certain embodiments comprising a first fastening feature fully engaged with a second fastening feature as shown in FIG. 5A FIG. 7B—A section view of certain embodiments comprising a first fastening feature partially engaged with a second fastening feature as shown in FIG. 5B FIG. 7C—A section view of certain embodiments comprising a first fastening feature disengaged from a second fastening feature as shown in FIG. 5C FIG. 7D—A section view of certain embodiments comprising a first fastening feature removed from a second fastening feature as shown in FIG. 5D FIG. 8A—A side view of certain embodiments comprising a cleaning element having a first aperture and a second aperture FIG. 8B—A front view of certain embodiments comprising a cleaning element having a first aperture and a second aperture FIG. 8C—An isometric view of certain embodiments comprising a cleaning element having a first aperture and a second aperture FIG. 9A—A side view of certain embodiments comprising a cleaning element having a sleeve with a deformable solid disposed therein FIG. 9B—A section view of certain embodiments comprising the cleaning element as shown in FIG. 9A FIG. 10A—A side view of certain embodiments comprising a semi-rigid shaft having fastening features at the ends FIG. 10B—A detail view of the semi-rigid shaft shown in FIG. 10A FIG. 11—An exploded view of a system comprising a semi-rigid shaft, a first cleaning element, and a second cleaning element.
Figure 1B:
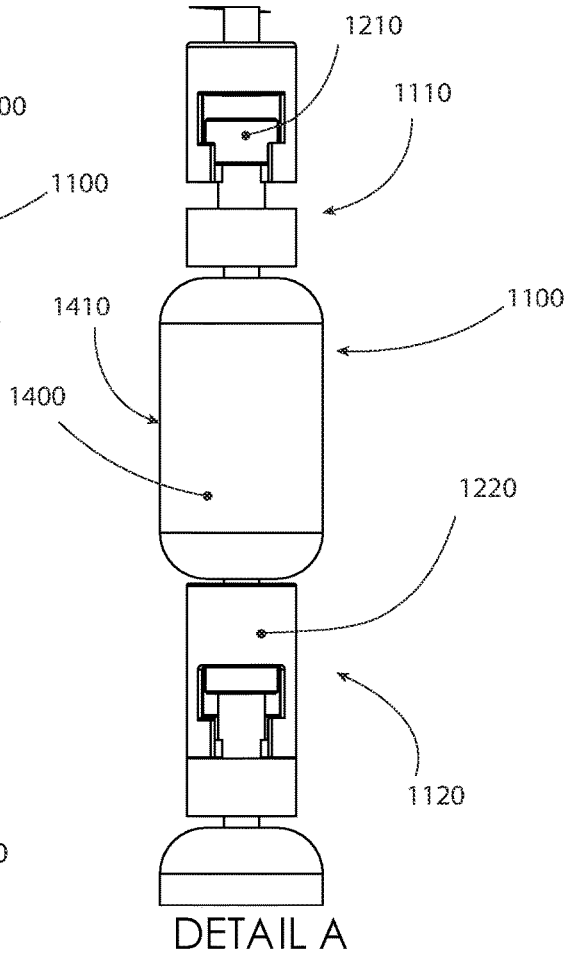
Figure 1C:
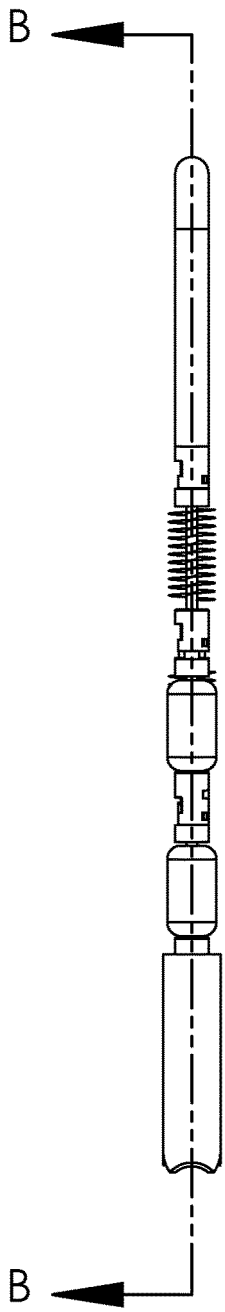
Figure 1D:
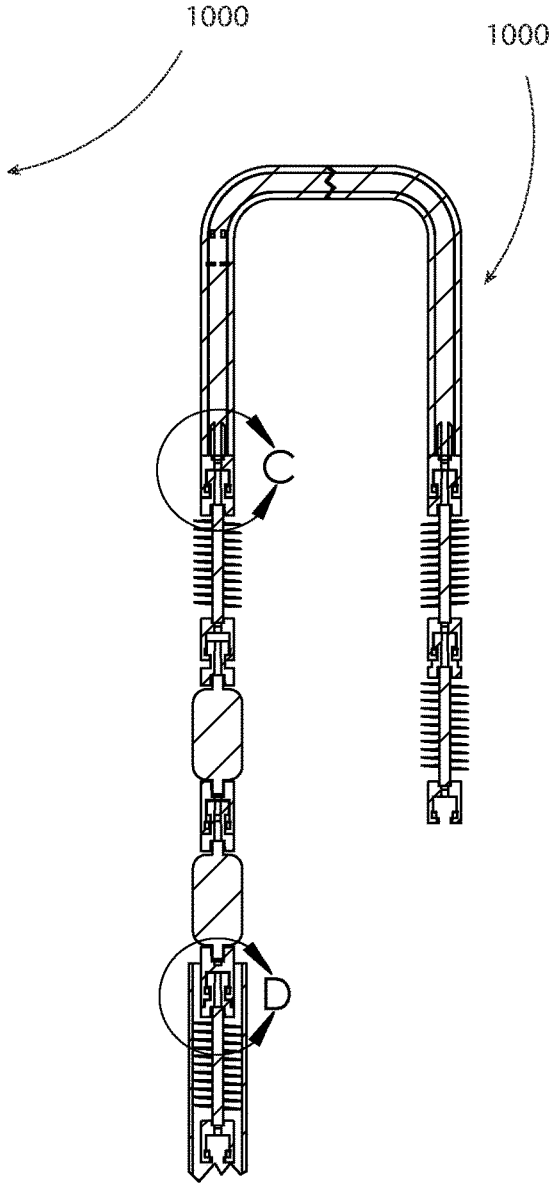
Figure 1E:
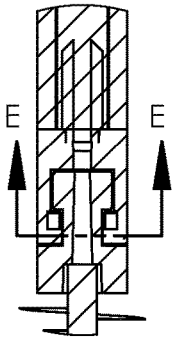
Figure 1F:
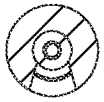
Figure 1G:
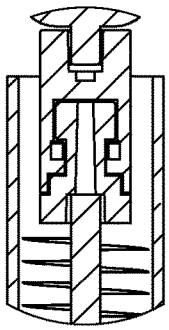
Figures 5A, 5B, 5C, 5D:
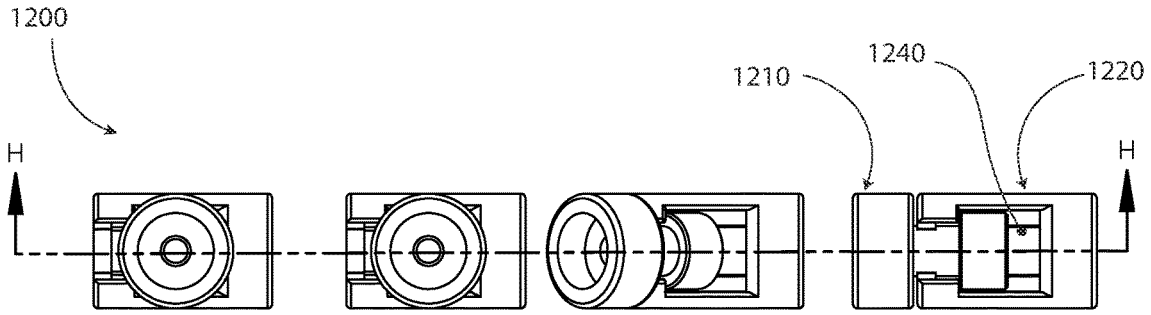
Figures 6A, 6B, 6C, 6D:
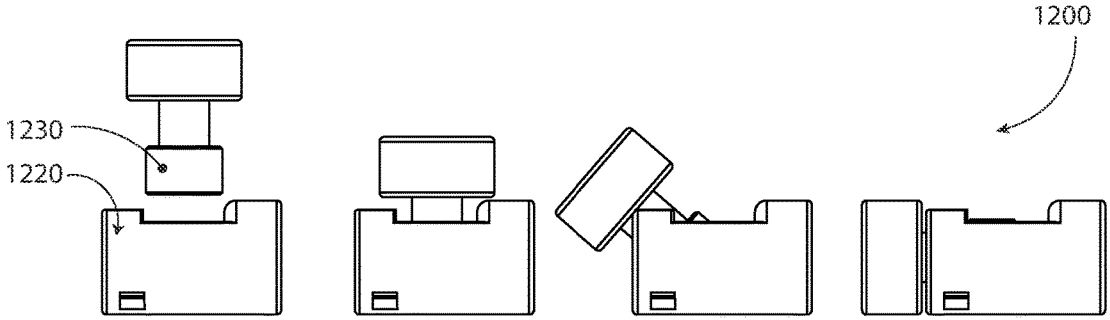
Figures 7A, 7B, 7C, 7D:
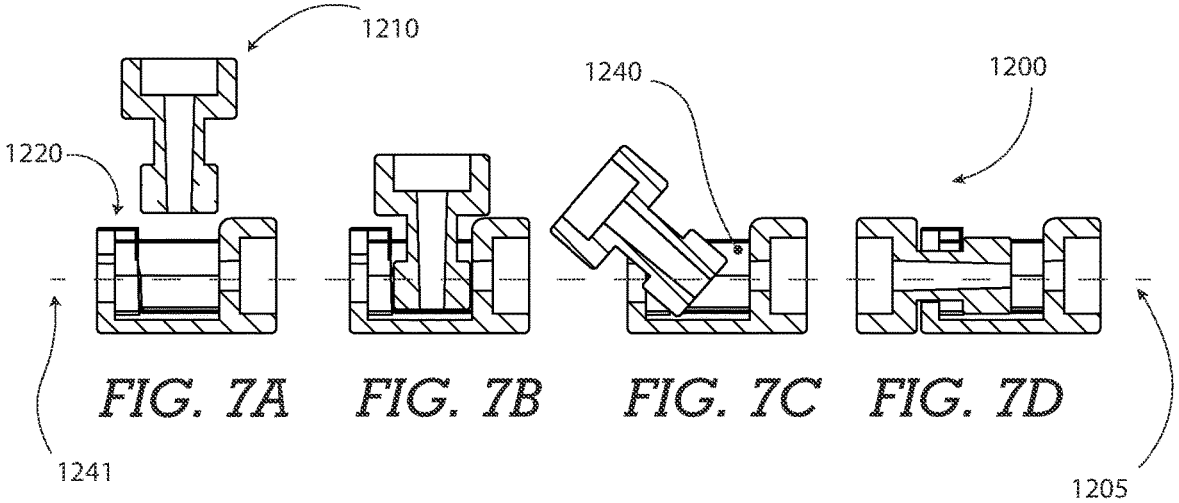

In certain embodiments, as shown in FIG. 1A-FIG. 11, the present invention comprises a cleaning device 1000 comprising a first cleaning element 1100 adapted to pass through a barrel of a firearm and clean internal surfaces of a barrel of a firearm, wherein the first cleaning element 1100 comprises a first fastening feature 1210 interconnected with a first end 1110 of the first profile cleaner, and a second fastening feature 1220 interconnected with a second end 1120 of the first profile cleaner.

In certain embodiments, the present invention comprises a first cleaning element 1100 and a second cleaning element 1100. It will be appreciated that the cleaning elements 1100 of certain embodiments comprise similar cleaning elements, while alternate embodiments comprise differing cleaning elements. The cleaning elements each comprise a first fastening 1210 feature interconnected to a first end 1110, and each cleaning element comprises a second fastening feature 1220 interconnected to a second end 1120. The first fastening feature 1210 of each cleaning element is configured to removably interconnect with the second fastening feature 1220 of each cleaning element. Thereby, the first and second cleaning elements 1100 are interconnectable in a first configuration and a second configuration.

In certain embodiments, the present invention comprises a plurality of cleaning elements 1100, each of the plurality of the cleaning elements comprising a first fastening feature 1210 at the first ends 1100 of the cleaning elements, and each of the plurality of the cleaning elements each comprise a second fastening 1220 feature at the second ends 1120 of the cleaning element. The first fastening feature 1210 of each cleaning element is removably interconnectable with a second fastening feature 1220 of each cleaning element. Thereby, a user is able to configure a cleaning device 1000 comprising a plurality of cleaning elements 1100 with any combination of cleaning elements, with any order of cleaning elements. It will be appreciated that such "daisy-chaining" of elements is not limited to any number, combination, or configuration of elements as disclosed herein.

As shown in FIG. 1A-FIG. 1D, the cleaning elements of certain embodiments comprise a variety of forms. Certain cleaning elements comprise a profile cleaner 1300 which is configured to clean the internal volume of elements such as the internal surface of a barrel. The cleaning elements of certain embodiments, such as the profile cleaner 1300, comprise a shaft having a semi-rigid property thereby allowing both flexibility and anti-kinking properties. Such properties allow for the navigation of a cleaning element from the breach-end of a firearm allowing the cleaning device to be advanced through the barrel from the breach-end toward the muzzle end of the firearm by pulling or pushing the cleaning element.

As shown in FIG. 1A-FIG. 1D, the cleaning elements of certain embodiments, such as a deformable cleaner 1400 comprise a form which are dissimilar (e.g., larger in diameter) to the internal aspects of a firearm such as the breach, barrel, or other aspect which is the target of cleaning. Such cleaning elements comprise a deformable outer surface 1410 wherein forcing such a cleaning element through a firearm results in deforming the outer surface of the cleaning element to match the inner surface of the firearm, allowing the cleaning element to pass through and clean the firearm.

As shown in FIG. 1A-FIG. 1D, the cleaning elements of certain embodiments comprise a wire-brush 1500 or other stiff-bristled aspects configured to pass through a firearm to scour and clean the internal surfaces of a firearm.

Shown in FIG. 4, the cleaning element of certain embodiments comprise a clamping element 1600 comprising a first clamping member 1610 and a second clamping member 1620 each axially slidably affixable along an axial member 1630. The first clamping member comprises a textured surface 1640 and the second clamping member comprises a textured surface 1640, wherein the textured surfaces of the clamping members are disposed toward each other. Thus, a user is permitted to sandwich a cleaning element—such as a cloth patch or brush—between the clamping elements and lock the clamping elements in place along the axial member 1630. The clamping element 1600 can then be passed through the firearm to clean the internal surface of the firearm. In certain embodiments, the textured surfaces comprises teeth 1650, but are not limited thereto. Alternative embodiments comprise a first clamping element 1610 which is configured to sandwich a cleaning element between the first clamping element 1610 and a rigid cap 1660. Such cleaning elements allow for the use of improvised cleaning with any material suited for the cleaning of the internal aspects of a firearm such as textiles, paper products such as coffee filters, steel wool, and other cleaning materials known to a person having ordinary skill in the art.

Certain fastening features (1200, 1210, 1220) of various embodiments are discussed herein, such as those shown in FIG. 1A-FIG. 3B, and FIG. 5A-FIG. 7D, but are not limited thereto. The fastening features of certain embodiments comprise a first fastening feature 1210 comprising a male feature 1230 (such as a ball or stud), and a second fastening feature 1220 comprising a female feature 1240 (such as a socket). In certain embodiments, shown in FIG. 2A-FIG. 3B the connection of a male feature 1230 to a female feature 1240 requires the male feature 1230 to be interconnected with the female feature 1240 by inserting the male feature 1230 into the female feature 1240 from a lateral aspect resulting in the male feature 1230 parallel to the female feature 1240.

In certain embodiments, FIG. 5A-FIG. 7D, a male feature 1230 of a first fastening feature 1210 is inserted into the recess of the female feature 1240 of a second fastening feature 1220 from a lateral aspect (FIG. 5A-FIG. 5B, FIG. 6A-FIG. 6B, FIG. 7A-FIG. 7B) with the male feature 1230 oriented orthogonally to the longitudinal axis 1205 of the female feature. The male feature 1230 is then rotated (FIG. 5C-FIG. 5D, FIG. 6C-FIG. 6D, FIG. 7C-FIG. 7D) to align with the axis of fixation 1205. Each of the aforementioned fastening features 1200 are configured to allow articulation between cleaning elements while mitigating the disconnection of adjacent cleaning elements when loaded axially in tension or compression.

The fastening features as shown in FIG. 5A-FIG. 7D provide an interconnection the male feature 1230 of a first fastening feature and a female feature 1240 of a second fastening feature resulting in the interconnection of the first fastening feature 1210 with the second fastening feature 1220 such that the first fastening feature 1210 and second fastening feature 1220 are longitudinally constrained along an axis 1205 while permitting the first fastening feature 1210 to rotate with respect to the second fastening feature 1220.

In certain embodiments, shown in FIG. 8A-FIG. 11, the fastening features comprise male threaded features 1250 and female threaded features 1260.

Figures 8A, 8B, 8C:
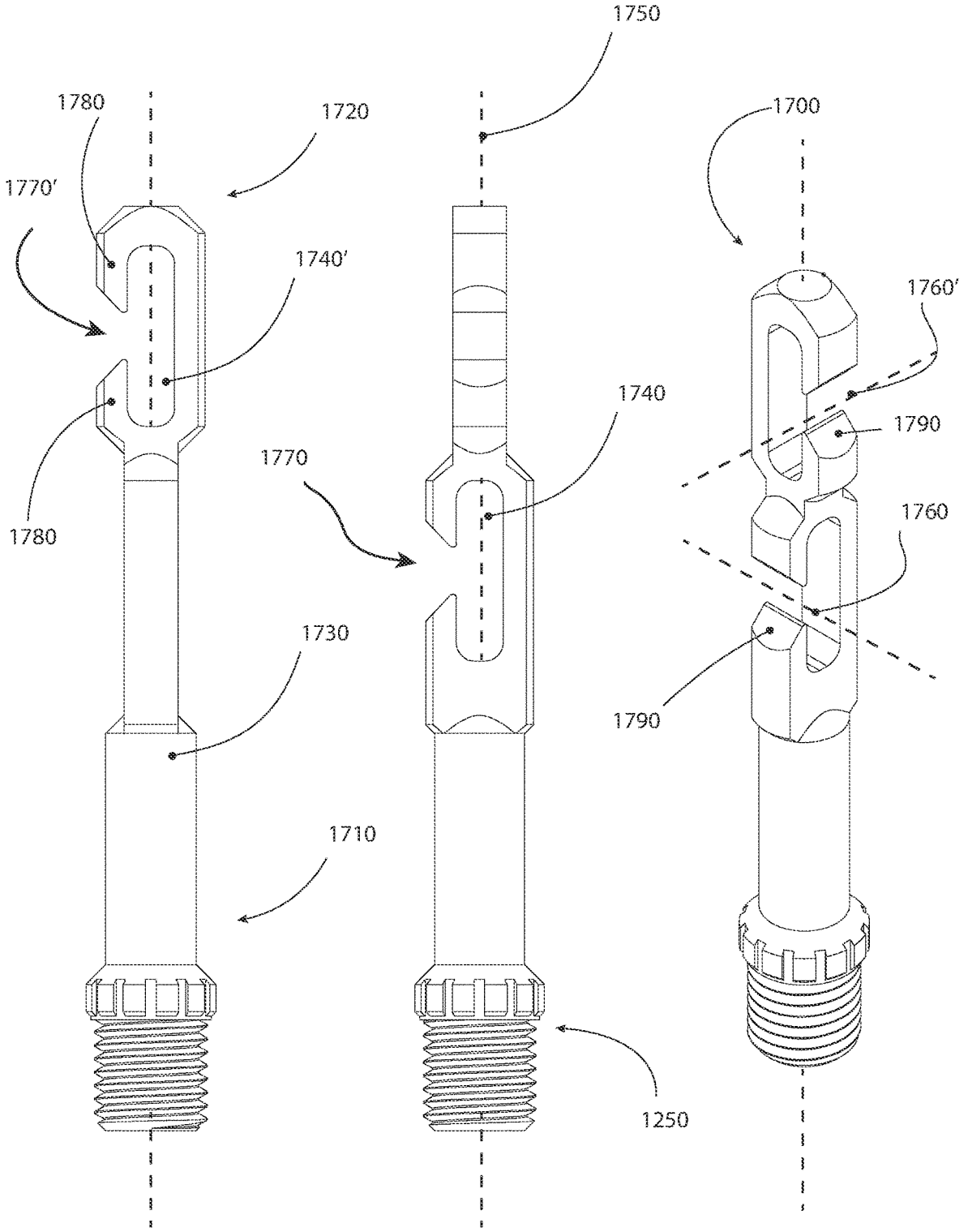

In certain embodiments, shown in FIG. 8A-FIG. 8C, a firearm cleaning device comprises a cleaning element 1700 comprising a first end 1710, a second end 1720, and a shank 1730 therebetween. A first aperture 1740 and the second aperture 1740' are aligned with a longitudinal axis 1750 of the shank, and the apertures are proximal to the second end of the cleaning element. The first aperture 1740 and the second aperture 1740' are angularly offset from each other. Thus, the apertures each have an axis (1760, 1760') extending therethrough which is perpendicular to a longitudinal axis 1750 of the shank, while the axis 1760 of the first aperture is non-parallel with the axis 1760' of the second aperture. In certain embodiments the angular offset of the axis 1760 of the first apertures is radially offset from the axis 1760' of the second aperture by 90-degrees. It will be appreciated that although embodiments disclosed herein comprise two apertures (1740, 1740'), embodiments comprising three or more apertures are within the spirit and scope of the present invention. It will be appreciated that such cleaning elements as shown in FIG. 8A-FIG. 8C allow for the use of improvised cleaning with any material suited for the cleaning of the internal aspects of a firearm such as textiles, paper products such as coffee filters, steel wool, and other cleaning materials known to a person having ordinary skill in the art.

In certain embodiments, as shown in FIG. 8C, a cleaning element further comprises a jag 1795, or spike, disposed at a distal end of the cleaning element wherein a cloth patch or similar can be pierced by the jag 1795 prior to pushing it through the internal aspects of a firearm to retain the cloth patch to the cleaning element.

In certain embodiments the apertures further comprise a lateral opening (1770, 1770') thereby creating a hook-form.

The lateral opening (1770, 1770') permits a user to place a cloth patch or other cleaning element therethrough laterally and into the aperture. It will be appreciated that the lateral opening of certain embodiments is configured to result in an upper hook-form 1780' and lower hook-form 1780 wherein the cloth patch is captive within the aperture regardless if the cleaning element is pushed or pulled through a firearm. In certain embodiments the lateral opening 1770 further comprises beveled aspects 1790 configured to guide the placement of a cloth patch into the apertures from a lateral aspect, while further restricting the removal of the cloth patch thereby mitigating the inadvertent removal of the cloth patch from the apertures.

Figure 9A:
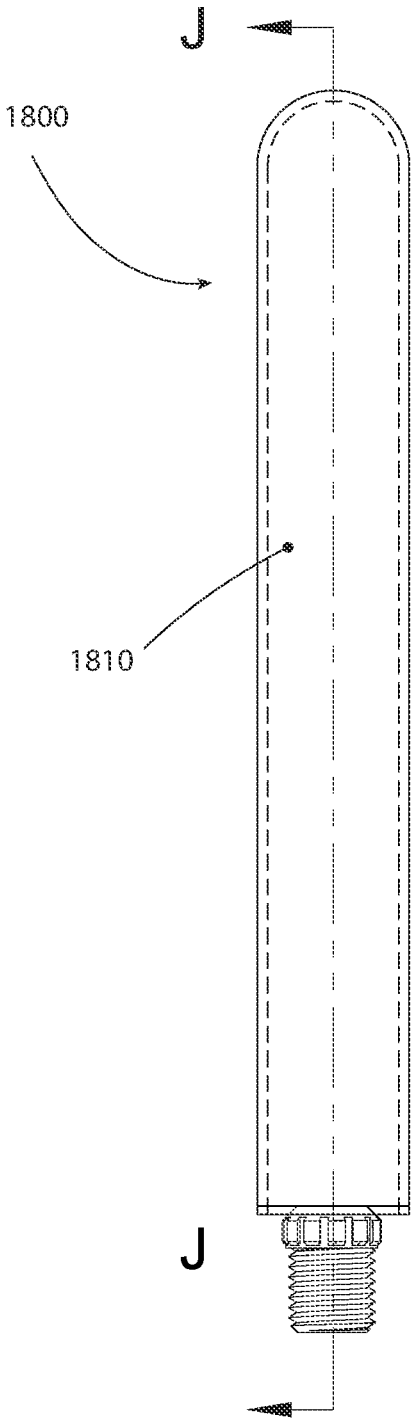
Figure 9B:
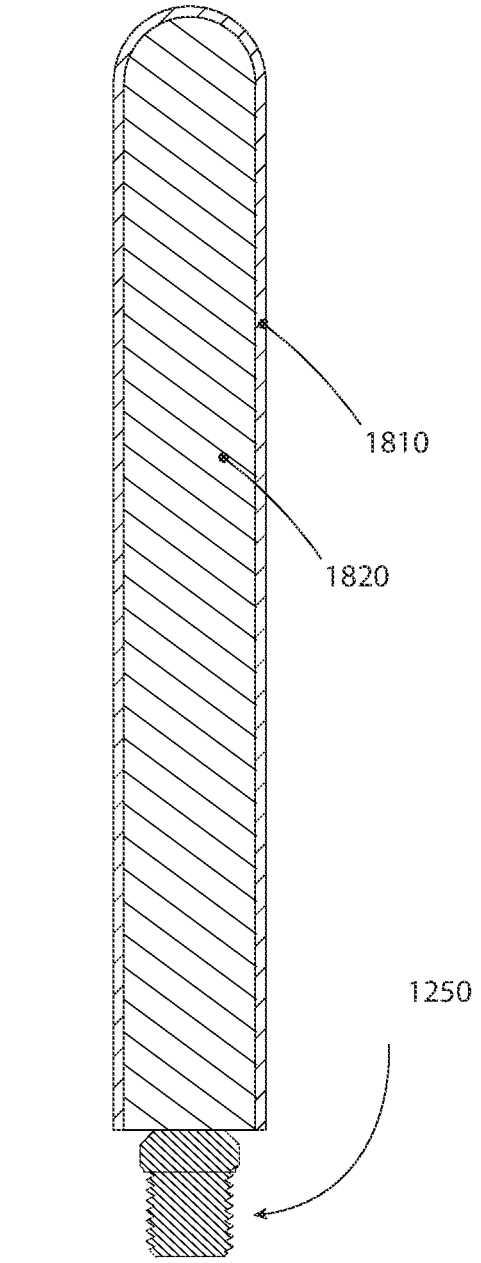

In certain embodiments of the present invention, shown in FIG. 9A-FIG. 9B, a cleaning element 1800 comprises a flexible outer sleeve 1810 with a deformable element therein 1820. The outer sleeve 1810 of certain embodiments comprises a textile configured to clean the internal aspects of a firearm. In certain embodiments the outer sleeve 1810 comprises a micro-fiber textile material, but it will be appreciated that alternative textiles known to those skilled in the art can be used while in keeping with the spirit and scope of the present invention. The deformable element 1820 comprises an oblong shape and is able to conform to the internal aspects of the firearm as the cleaning element is forced therethrough. The deformable element 1820 typically comprises a closed-cell foam, but embodiments using other deformable elements are within the spirit and scope of the present invention. In certain embodiments the cleaning element 1800 comprises a male threaded feature 1250 at a first end configured to removably interconnect with a fastening feature of other cleaning elements. Embodiments wherein the cleaning element comprises a female threaded feature, or alternative mechanical fixation feature, are within the spirit and scope of the present invention.

Figure 10A:
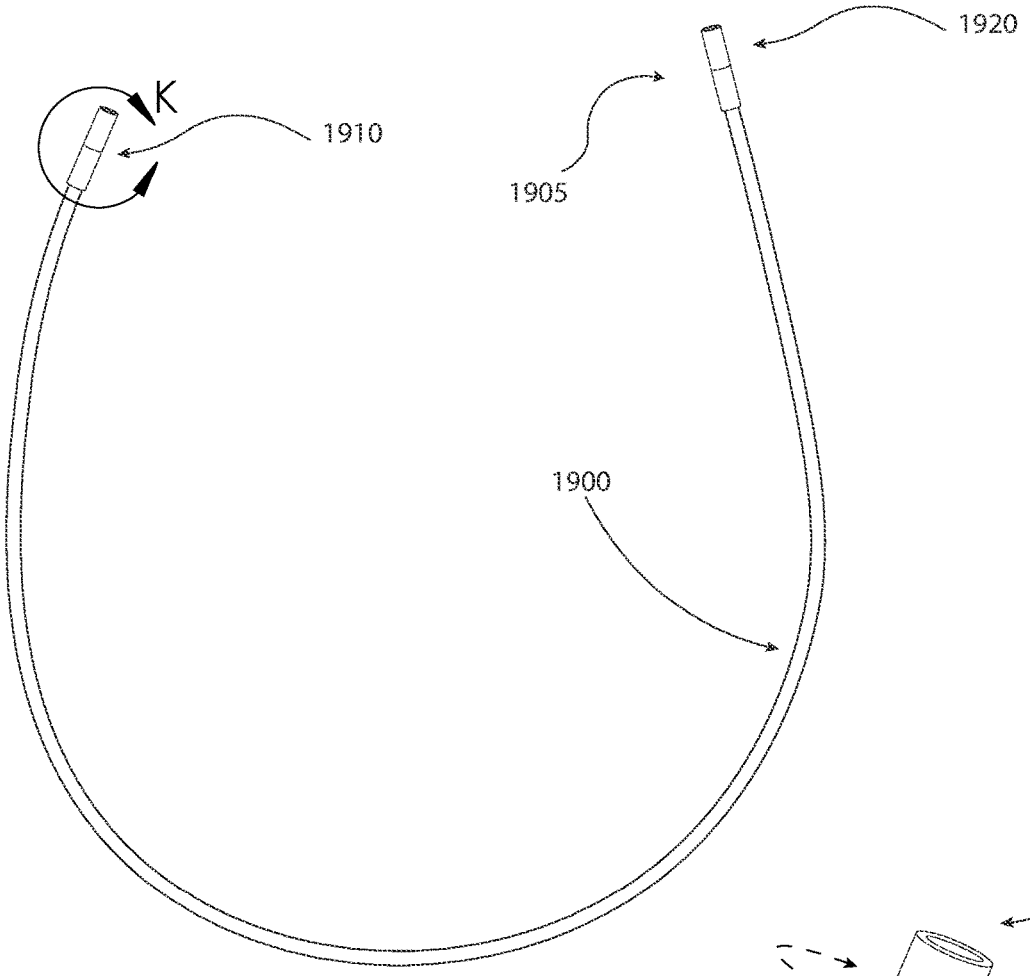
Figure 10B:
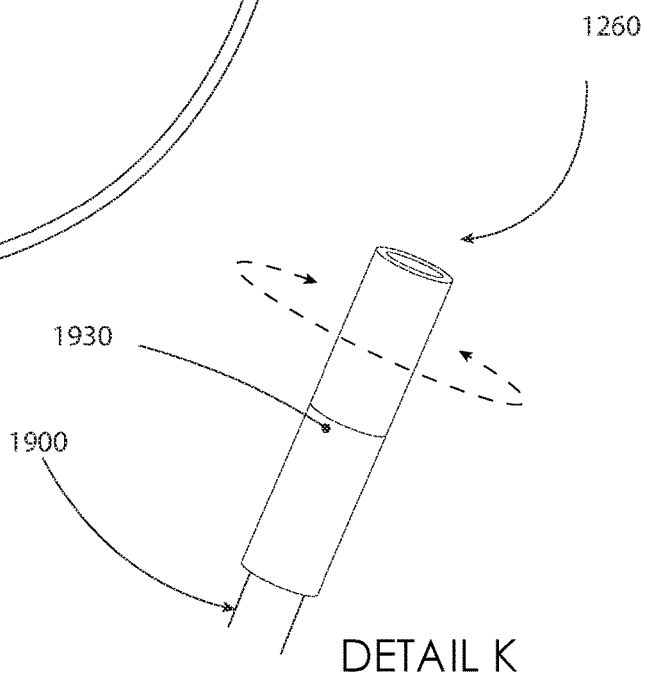
Figure 11:
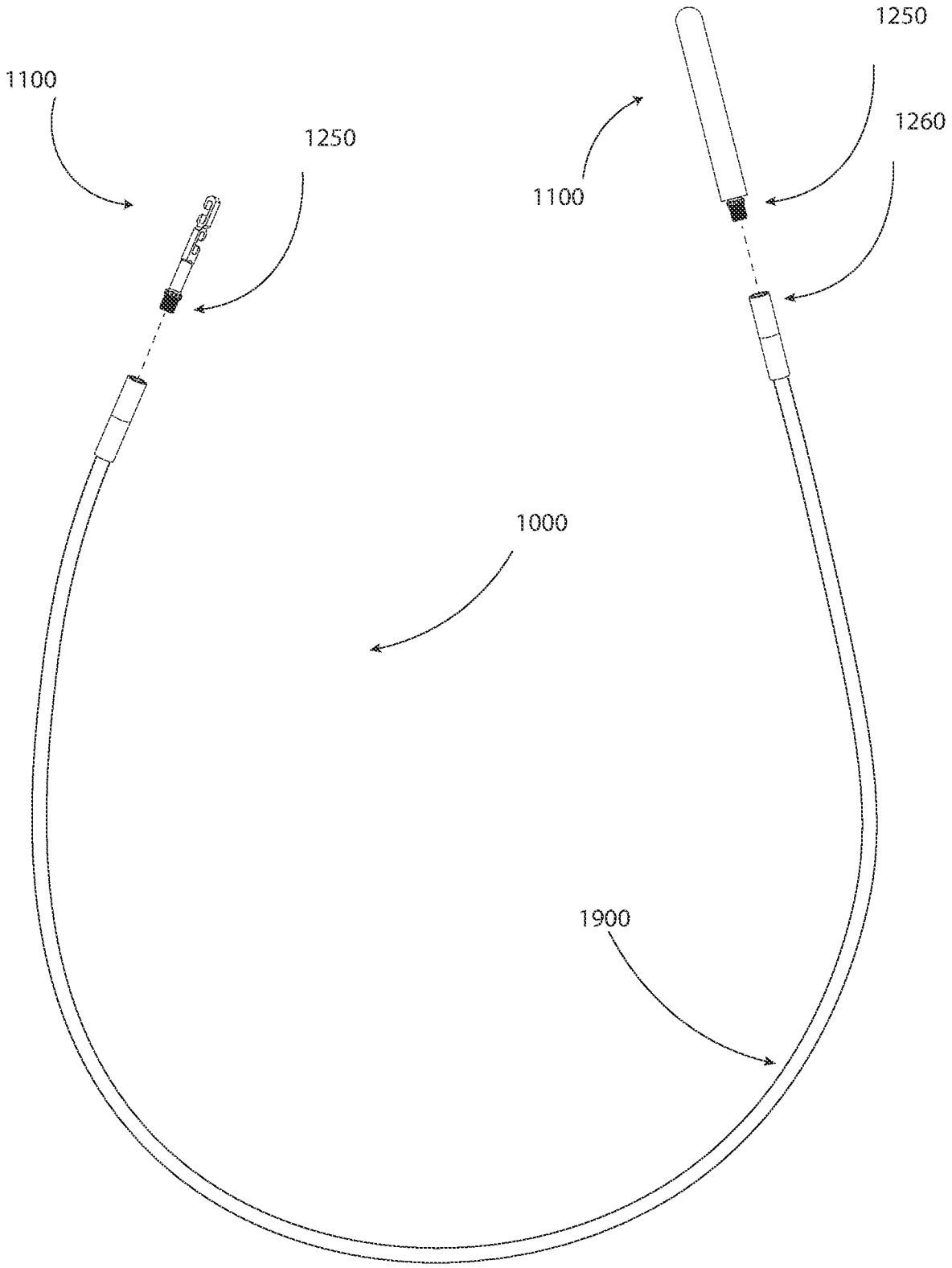

Certain embodiments of a firearm cleaning device 1000, shown in FIG. 10A-FIG. 11, comprises a semi-rigid shaft 1900 having a first end 1910 and a second end 1920. The ends of the semi-rigid shaft 1900 comprise fastening features 1905 configured to removably interconnect with fastening features of cleaning elements 1100. In certain embodiments, the fastening features 1905 of the semi-rigid shaft comprise female threaded features 1260 is configured to interconnect with the mechanical fixation features of the cleaning elements 1100 wherein the fastening features of the cleaning elements comprise male threaded features 1250. It will be appreciated that the fastening features of the semi-rigid shaft can comprise two female threaded features 1260, two male threaded features 1250, or a male threaded feature 1250 and a female threaded feature 1260 while in keeping with the spirit and scope of the present invention.

In certain embodiments, a firearm cleaning device comprises semi-rigid shaft 1900 having a first end and a second end, each comprising female threaded features configured to interconnect with cleaning elements having male threaded features.

In certain embodiments, shown in FIG. 10A-FIG. 10B, a semi-rigid shaft 1900 comprises fastening features at the first end 1910 and second end 1920, wherein the threaded features 1260 of the semi-rigid shaft further comprise a swivel connection 1930 between the threaded feature and semi-rigid shaft wherein the threaded features axially aligned with the semi-rigid shaft, while the threaded features are free to rotate independent of the semi-rigid shaft. The swivel connection allows the use of cleaning elements within rifled barrels without encumbrance from rifling and without damage to the rifling of the barrel. In certain embodiments, the swivel connection 1930 comprises a male feature 1230 and a female feature 1240 as shown in FIG. 5A-FIG. 7D which permits the modular attachment of one of many cleaning elements, wherein the male fastening feature is configured to freely rotate in relation to the female fastening feature.

In certain embodiments, shown in FIG. 11, a first cleaning element 1700 comprising two apertures which are angularly offset is removably interconnected to a first end 1910 of a semi-rigid shaft. Interconnected to a second end 1920 of the semi-rigid shaft is a second cleaning element 1800 comprising a textile sleeve having a deformable element therein.

Figures 12A, 12B, 12C:
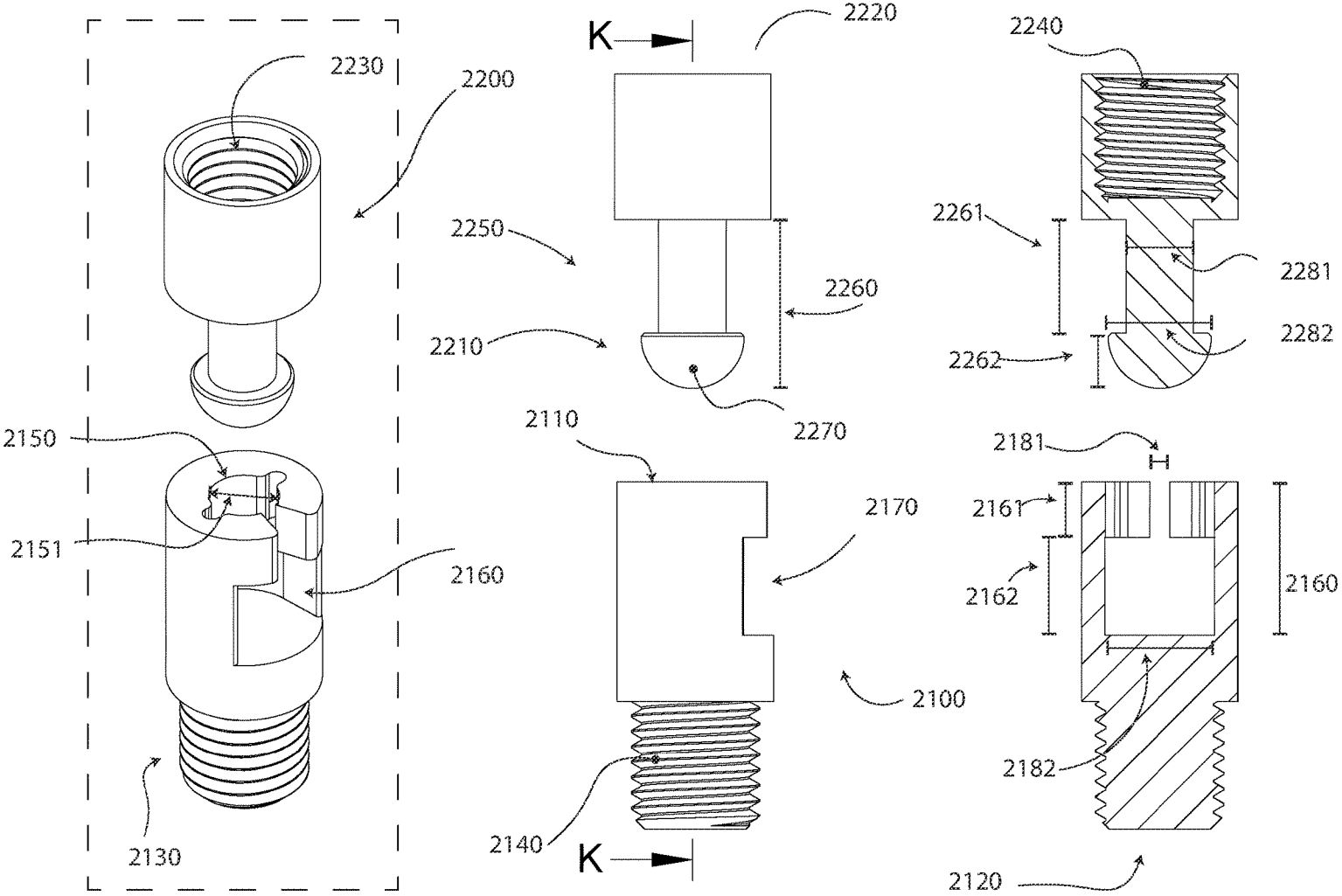
FIG. 12A—An exploded perspective view of a quick coupling system of certain embodiments FIG. 12B—An exploded side view of a quick coupling system of certain embodiments FIG. 12C—A section view of the quick coupling system shown in FIG. 12C FIG. 13A—An exploded perspective view of certain embodiments of a quick coupling system FIG. 13B—An exploded perspective view of certain embodiments of a quick coupling system FIG. 13C—An assembled perspective view of certain embodiments of a quick coupling system FIG. 14A—A top view of a female fastening feature of certain embodiments FIG. 14B—A top view of a female fastening feature of certain embodiments FIG. 15A—A bottom perspective view of a hand-grip of certain embodiments FIG. 15B—A bottom view of a hand-grip of certain embodiments FIG. 15C—A bottom view of a hand-grip of certain embodiments FIG. 15D—A front view of a hand-grip of certain embodiments FIG. 15E—A top view of a hand-grip of certain embodiments

In certain embodiments, as shown in FIG. 12, a quick coupling system 2000—also referred to as a fastening feature herein—comprises a female fastening feature 2100 having a first end 2110 configured to interconnect with a male fastening feature 2200. A second end 2120 of the female fastening feature comprises a mechanical fixation feature 2130, such as threaded features. The mechanical fixation feature of certain embodiments comprises male threaded 2140 features, while others comprise female threaded 2240 features. Embodiments comprising other mechanical fixation features are within the spirit and scope of the present invention. The first end 2110 of the female fastening feature comprises an aperture 2150, having a diameter 2151, protruding longitudinally into the female fastening feature from the first end 2110 toward the second end 2120 of the female fastening feature. The female fastening feature 2100 further comprises a recess 2160 in a lateral aspect 2170 of the female fastening feature, wherein the recess 2160 intersects with the aperture 2150. The length of the recess 2160 extends from the first end 2110 of the female fastening feature toward the second end 2120 of the female fastening feature, wherein a first portion 2161 of the recess intersects the first end 2110 of the female fastening feature and a second portion 2162 of the recess is offset toward the second end 2120 of the female fastening feature. A first portion of the recess comprises a width 2181, and a length 2161. A second portion of the recess comprises a width 2182, and a length 2162, wherein the width 2182 of the second portion of the recess is greater than the width 2181 of the first portion of the recess.

In certain embodiments, a quick coupling system 2000 comprises a male fastening feature 2200 having a first end 2210 configured to interconnect with a female fastening feature 2100. In certain embodiments, a second end 2220 of the male fastening feature comprises a mechanical fixation feature 2230, such as female threaded features 2240. The mechanical fixation feature of certain embodiments comprises male threaded features 2140, while others comprise female threaded features 2240. Embodiments comprising other examples mechanical fixation features 2230 are within the spirit and scope of the present invention.

The first end 2210 of the male fastening feature comprises a stud 2250 extending longitudinally away from the male fastening feature. In certain embodiments, the length 2260 of the stud is less than the length 2160 of the recess of the female fastening feature 2100 to which the male fastening feature 2200 is configured to interconnect with. The stud 2250 comprises a first portion having a length 2261, and a second portion having a length 2262, wherein the second portion is located distally from the first portion. In certain embodiments the second portion of the stud comprises a hemispherical shape 2270, however a second portion of the stud comprising alternate geometric shapes are within the spirit and scope of the present invention.

The first portion of the stud comprises a length 2261 greater than the length 2161 of the first portion of the recess of the female fastening feature, and the second portion of the stud comprises a length 2262 less than the length 2162 of the second portion of the recess of the female fastening feature. The second portion of the stud comprises a width 2282 greater than a width of the first portion of the stud. Furthermore, the width 2282 of the second portion of the male fastening feature is less than the width 2182 of the second portion of the recess of the female fastening feature, wherein the width 2282 of the second portion of the stud is configured to pass through the width 2182 of the second portion of the recess. In certain embodiments, the width 2281 of the first portion of the stud is configured to pass through the width 2181 of the first portion of the recess. In certain embodiments the width 2281 of the first portion of the stud is less than the width 2181 of the first portion of the recess. In certain embodiments the width 2281 of the first portion of the stud is equal to or greater than the width 2181 of the first portion of the recess. In certain embodiments the type of fit between the width 2281 of the first portion of the stud and the width 2181 of the first portion of the recess comprises a transition fit wherein the first portion of the stud is configured to pass through the first portion of the recess with light pressing force.

Figure 13A:
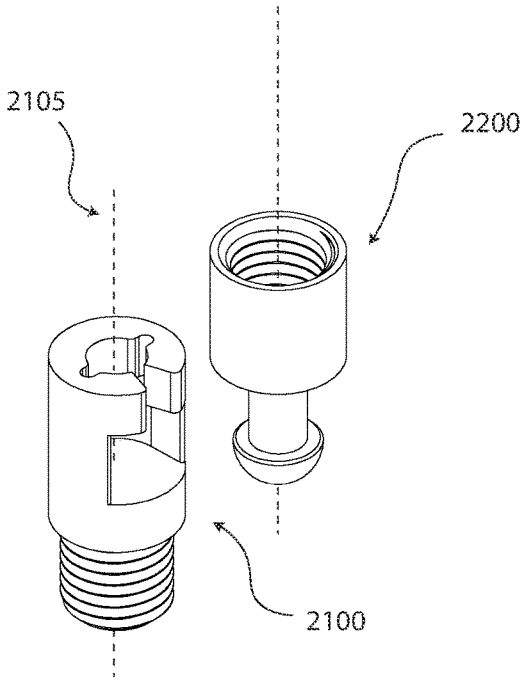
Figure 13B:
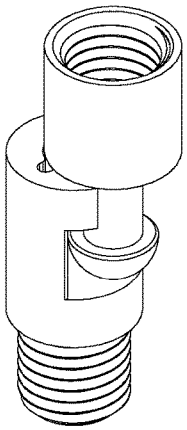
Figure 13C:
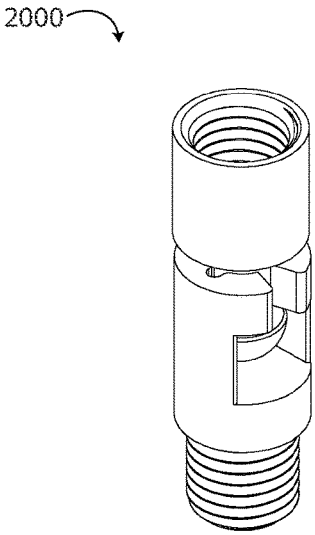

Embodiments, shown in FIG. 13A-FIG. 13C for example, allowing the interconnection of a female fastening feature 2100 and a male fastening feature 2200 by advancing the stud 2250 parallel to the longitudinal axis 2105 of the female fastening feature 2100 are within the spirit and scope of the present invention.

Figure 14A:
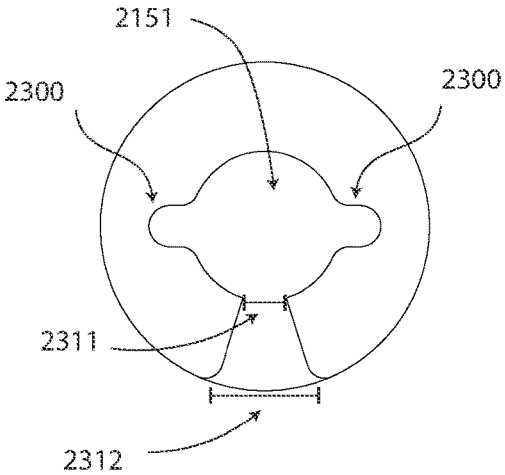
Figure 14B:
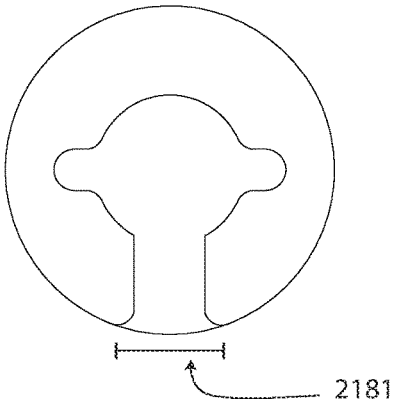
Figure 15A:
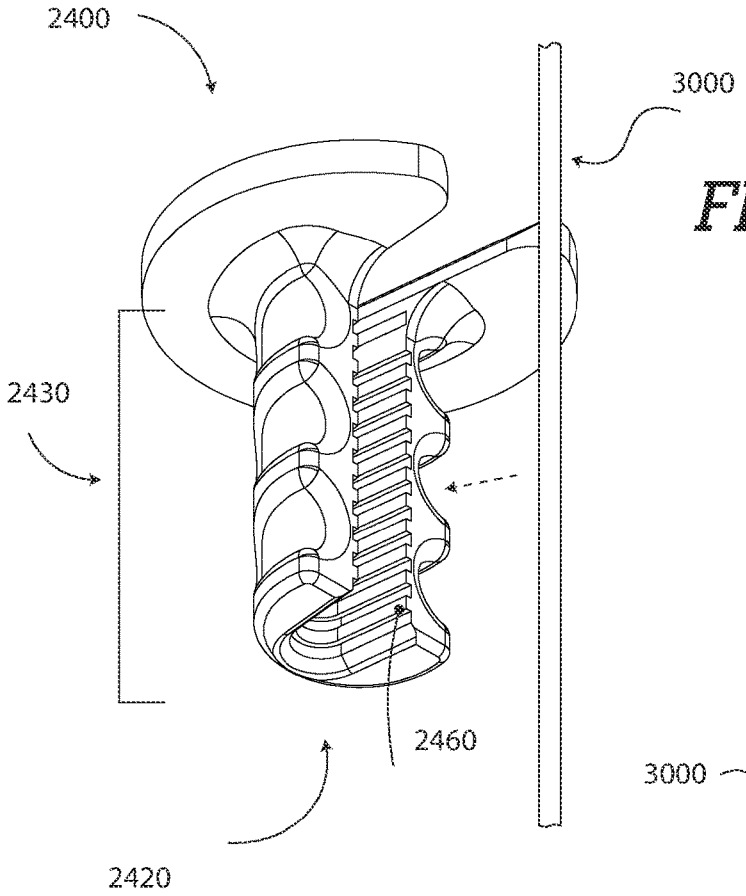
Figure 15B:
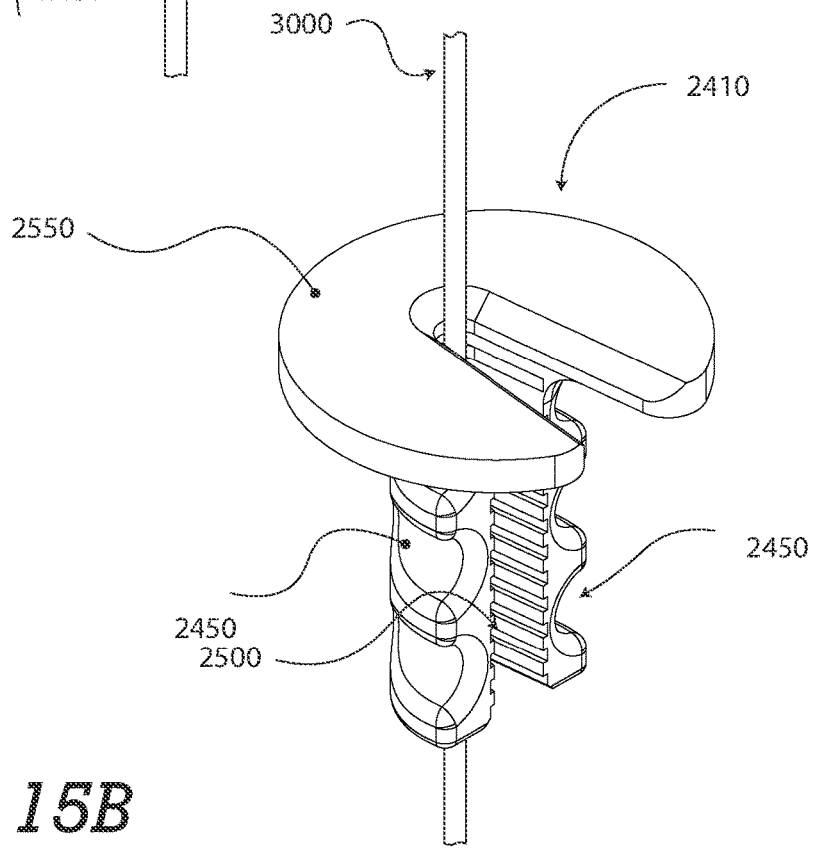
Figure 15C:
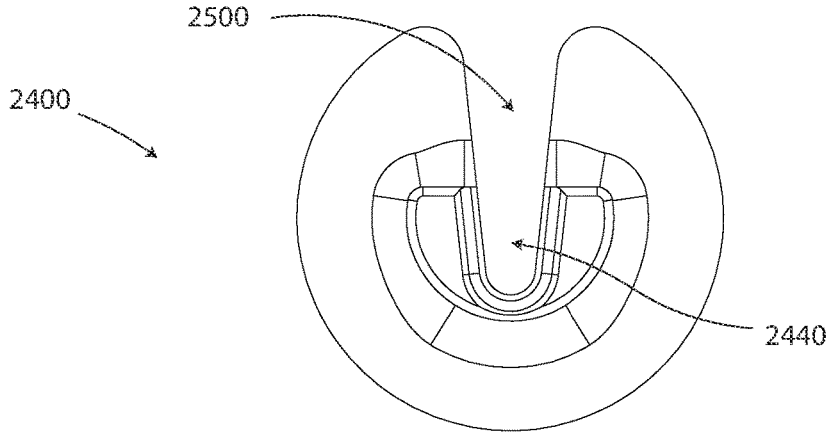
Figure 15D:
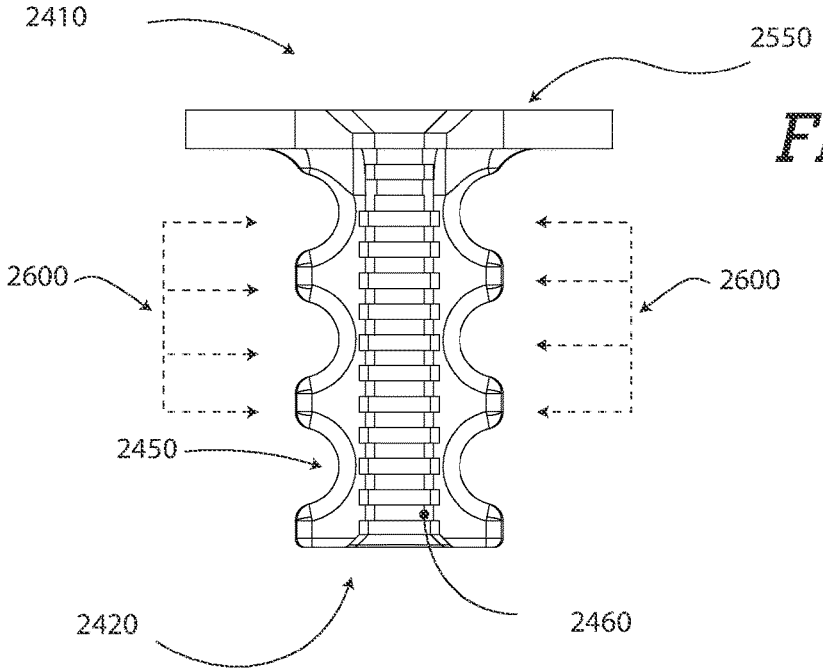
Figure 15E:
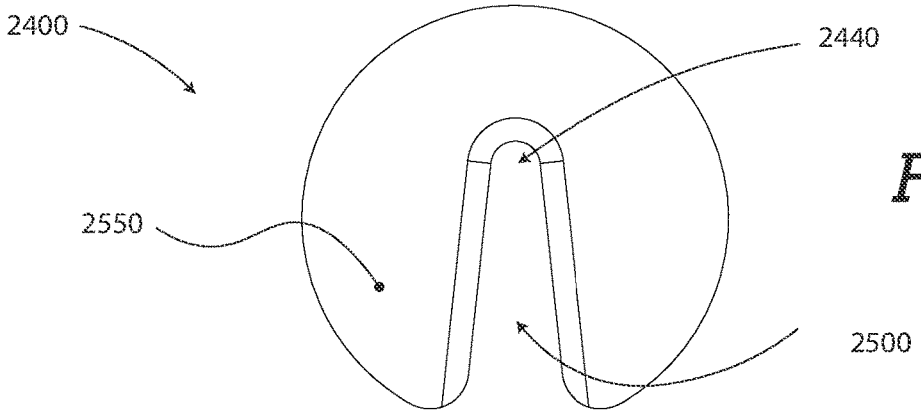

In certain embodiments of the present invention, for example as shown in FIG. 14A-FIG. 14B, an aperture 2150 of the female fastening feature comprises at least one stress relief feature 2300 comprising a cutout which extending the length of the first portion of the recess. The stress relief feature 2300 extends radially away from the aperture of the female fastening feature wherein the stress relief feature allows 2300 the width 2181 of the first portion of the recess to expand when the first portion of the stud is inserted therethrough without permanent deformation to the female fastening feature 2100.

In certain embodiments, as shown in FIG. 14A, the width of the first portion of the recess tapers from a maximum width 2312 to a minimum width 2311. In alternate embodiments, as shown in FIG. 14B, the width of the first portion of the recess of is consistent.

In certain embodiments, a second end of the male fastening feature comprises an annulus wherein an aperture through the annulus is configured to receive an object such as a rag, or a tether of a cleaning element.

Certain embodiments of the present invention comprise a hand-grip 2400 comprising an oblong grip 2430 having a longitudinal pathway 2440 extending from a first end 2410 of the hand-grip to a second end 2420 of the hand-grip. The hand-grip 2400 comprises a plurality of recesses 2450 on the external aspect of the grip portion, wherein the recesses 2450 are configured to receive the fingers of a user for increased grip. The pathway 2440 further comprises a plurality of protuberances 2460 which extend radially inward within the pathway 2440 wherein the protuberances 2460 are configured to provide increased grip to a longitudinal element 3000 inserted within the pathway.

In certain embodiments, the hand-grip 2400 comprises an open lateral aspect 2500 where through a longitudinal element 3000 can be inserted into the pathway 2440 through open lateral aspect 2500. Once a longitudinal element 3000 is inserted into the pathway 2440, the user grasps the grip and applies force 2600 radially inward on the grip 2430 which constricts the pathway 2440 and engages the protuberances 2460 with the longitudinal element 3000, thereby enabling the user to push or pull the longitudinal element through a firearm. Upon finishing a pulling or pulling stroke, the user can release the force applied radially inward on the grip 2430, which permits the grip to rebound and allow the user to slide the hand-grip 2400 along the longitudinal element 3000 to reset for a subsequent pulling or pushing stroke.

In certain embodiments, the first end 2410 of the hand-grip comprises a hand-guard 2550 wherein the hand-guard 2550 extends radially outward from the hand-grip 2430. Although embodiments as shown comprise a planar hand-guard 2550, alternative embodiments wherein the hand-guard 2550 has a convex, concave, or other geometric shape are within the spirit and scope of the present invention. In certain embodiments, the lateral open aspect 2500 of the hand-grip extends through the hand-guard 2550.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A firearm cleaning system comprising:

a semi-rigid shaft comprising a first end and a second end, the ends of the semi-rigid shaft configured to interconnect with a quick-coupling system;

the quick-coupling system configured to interconnect to a first end of the semi-rigid shaft;

the quick-coupling system comprising a male fastening feature and a female fastening feature;

the female fastening feature comprises an aperture through a first end of the female fastening feature, and the male fastening feature comprises a stud extending from a first end of the male fastening feature;

wherein the female fastening feature and the male fastening feature are configured to be interconnected to each other;

wherein the male fastening feature and the female fastening feature are configured to rotate freely in relation to each other.

2. The firearm cleaning system of claim 1, wherein the female fastening feature further comprises a recess in a lateral aspect of the female fastening feature; and the recess extends from the first end of the female fastening feature toward the second end of the female fastening feature, wherein the stud of the male fastening feature is inserted into the recess from a lateral direction into the recess to interconnect the male fastening feature to the female fastening feature.

3. The firearm cleaning system of claim 2, wherein the recess comprises a first portion interconnects with the first end of the female fastening feature, and wherein the first portion of the recess comprises a length, and a width; and the recess further comprising a second portion interconnected to the first portion of the recess, wherein the second portion of the recess is offset toward the second end of the female fastening feature, wherein the second portion of the recess comprises a length and a width, wherein the width of the second portion of the recess is greater than the width of the first portion of the recess.

4. The firearm cleaning system of claim 3, wherein the stud comprises a first portion interconnected to the first end of the male fastening feature, wherein the first portion of the stud comprises a width and a length; and a second portion of the stud, interconnected to the first portion of the stud and located distally from the first portion of the stud, comprises a width and a length, wherein the width of second portion of the stud is less than the width of the second portion of the recess, wherein the length of the second portion of the stud is less than the length of the second portion of the recess, and wherein the width of the first portion of the stud is configured to pass through the width of the first portion of the recess.

5. The firearm cleaning system of claim 4, wherein the width of the first portion of the recess is greater than a diameter of the aperture of the female fastening feature.

6. The firearm cleaning system of claim 5, wherein the width of the first portion of the stud and the width of the first portion of the recess are configured to have a transition fit.

7. The firearm cleaning device of claim 6, wherein the width of the first portion of the recess tapers from a maximum width to a minimum width, wherein the minimum width is less than the diameter of the aperture.

8. The firearm cleaning device of claim 6, wherein the width of the first portion of the recess is constant.

9. The firearm cleaning device of claim 6, wherein the second portion of the stud comprises a hemispherical shape.

10. The firearm cleaning device of claim 9, wherein the second end of the male fastening feature comprises an annulus comprising an aperture therethrough.

11. The firearm cleaning system of claim 2, wherein the ends of the semi-rigid shaft are configured to interconnect with the quick-coupling system with threaded features.

12. The firearm cleaning system of claim 11, wherein the ends of the semi-rigid shaft further comprise a swivel connection between the threaded features and the semi-rigid shaft.

13. The firearm cleaning device of claim 11, wherein the ends of the semi-rigid shaft are configured to interconnect with the second end of the female fastening feature.

14. The firearm cleaning device of claim 13, wherein the second end of the male fastening feature comprises a female threaded feature.

15. The firearm cleaning device of claim 13, wherein the second end of the male fastening feature is configured to receive a cleaning element selected from the group consisting of: a radially deformable cleaner, a wire brush, a clamping element, a first shank having an aperture therethrough, and a second shank having a first aperture and a second aperture therethrough.

* * * * *